US005267928A

United States Patent [19]

Barile et al.

[11] Patent Number: 5,267,928

[45] Date of Patent: Dec. 7, 1993

[54] REHABILITATION DEVICE

[75] Inventors: Raymond J. Barile, Groton, N.Y.; Thomas M. Sawa, Mississauga, Canada

[73] Assignee: Brace International, Atlanta, Ga.

[21] Appl. No.: 881,649

[22] Filed: May 12, 1992

[51] Int. Cl.[5] ..... A63B 21/02

[52] U.S. Cl. ..... 482/124; 482/105; 2/70; 2/228; 602/23

[58] Field of Search ..... 482/74, 121, 124, 131, 482/105; 2/227, 228, 230, 231, 233, 22, 23, DIG. 6.7; 128/95.1, 96.1; 602/61, 16, 23, 27

[56] References Cited

U.S. PATENT DOCUMENTS

| | | | |
|---|---|---|---|
| 4,303,239 | 12/1981 | Walsh, Jr. | 482/105 |
| 4,644,946 | 2/1987 | Gremona-Bonato | 602/61 |
| 4,756,525 | 7/1988 | Whitsitt | 482/105 |
| 4,768,236 | 9/1988 | Klob | 2/227 |
| 4,894,867 | 1/1990 | Ceravolo et al. | 2/DIG. 6 |
| 5,010,596 | 4/1991 | Brown et al. | 2/228 |
| 5,016,621 | 5/1991 | Bender | 2/22 |
| 5,054,127 | 10/1991 | Zevchak | 2/227 |
| 5,075,902 | 12/1991 | McReynolds et al. | 2/227 |
| 5,109,546 | 5/1992 | Dickey | 2/227 |
| 5,144,694 | 9/1992 | Daoud et al. | 2/228 |

*Primary Examiner*—Richard J. Apley
*Assistant Examiner*—Jeanne M. Mollo
*Attorney, Agent, or Firm*—H. Jay Spiegel

[57] ABSTRACT

A device is disclosed which includes a short pant with both a drawstring and cinches designed to cinch the leg portions tightly. Hook and pile fastening halves are disposed at various areas in the front and back of the pant and two elongated straps having hook and pile fastening halves on their ends are attached at one end to side seams of the pant. Through manipulation of these straps as well as auxiliary straps forming a part of the present invention, the user may provide proper support for their musculature to facilitate rehabilitation.

13 Claims, 3 Drawing Sheets

REHABILITATION DEVICE

BACKGROUND OF THE INVENTION

The present invention relates to a rehabilitation device. In the prior art, various wraps and wrapping techniques are known. However, Applicants are unaware of any device including all of the features and aspects of the present invention.

A need has arisen in rehabilitative medicine to assist and support contractile muscular tissues by mechanically supporting the normal musculature while the damaged soft tissue is healing. Such mechanical support hastens the rehabilitation process. Such support is also desirable as the patient resumes normal unrestricted activity to preclude recurrences of prior injuries. It is with these aspects in mind that the present invention was developed.

The following prior art is known to Applicants: U.S. Pat. No. 3,295,520 to Keller discloses a support device in the nature of an undergarment having various accessories designed to support the user. The present invention differs from the teachings of Keller as including the combination of a short pant along with a plurality of accessory straps.

U.S. Pat. No. 3,486,501 to Erickson et al. disclose an abdominal scultetus designed to be worn by a patient who has experienced abdominal surgery and intended to provide support for the abdominal area. The present invention differs from the teachings of Erickson et al. as including a short pant having upper and lower cinching mechanisms as well as strap attaching fasteners.

U.S. Pat. No. 3,506,000 to Baker teaches an ankle support in the nature of an elongated strap. The present invention differs from the teachings of Baker as contemplating the association of an elongated strap with a short pant.

U.S. Pat. No. 3,646,932 to Schultz discloses a groin support consisting of an elongated strap having a plastic piece attached thereto. The present invention differs from the teachings of Schultz as contemplating the combination of a short pant having straps attached thereto.

U.S. Pat. No. 4,905,678 to Cumins et al. disclose a hip stabilizer consisting of a belt, two thigh surrounding structures and a rigid brace. The present invention only uses flexible devices and, as such, is distinct from the teachings of Cumins et al.

U.S. Pat. No. 4,977,893 to Hunt discloses a surgical hip wrap in the nature of a bifurcated strap having fastening means. The present invention differs from the teachings of Hunt as contemplating the combination of a short pant having straps attached thereto.

SUMMARY OF THE INVENTION

The present invention relates to a rehabilitation device. The present invention includes the following interrelated objects, aspects and features:

(a) In a first aspect, the inventive device includes a short pant having a waist, and two short leg portions. The waist includes a drawstring allowing the waist to be tightened about the waist of the user. Each leg has a slit on the side thereof which may be tightened by a cinch strap and fastener to allow tightening of each leg of the pant about the respective legs of the user.

(b) The pant is preferably made of a strong stable heat retaining material such as, for example, 2 mm thick neoprene. The pant has side seams one on each diametrically opposed edge thereof outside the legs thereof. Attached at each seam is an elongated strap preferably made of an elastic material and having on each face thereof at its distal end a layer of the hook portion of a hook and pile fastening means.

(c) In four locations on the front of the pant, areas of the pile half of a hook and pile fastening means are provided.

(d) On the rear of the pant, four additional areas having pile portions of a hook and pile fastening means are provided. In the preferred embodiment, two of these areas consist of elongated strips extending from adjacent the waist downwardly with the other two areas being small squares adjacent the bottommost extent of the legs of the pant.

(e) The present invention also contemplates an auxiliary strap and an elongated wrap. The strap is shorter and has a small area of the hook portion of a hook and pile fastening means on each end thereof. The wrap is longer and wider than the strap and has one face having a small area at each end covered with the hook half of a hook and pile fastening means. At one of the ends of this wrap, on a face thereof opposite to the first mentioned face, a large area of the pile portion of a hook and pile fastening means is provided.

(f) Through interconnection of the inventive pant, elongated straps and strap and wrap of the present invention in prescribed ways, various injuries may be treated and rehabilitated. For example, among the injuries and conditions which may be successfully treated in accordance with the teachings of the present invention, are the following: adductor strains or tears, quadriceps/rectus femoris strains, support hamstring strains, tendonitis, hip flexor strains and deep thigh contusions. Of course other injuries and conditions may be suitably treated by the inventive device.

As such, it is a first object of the present invention to provide a rehabilitation device.

It is a further object of the present invention to provide such a device including a short pant having attachment means and straps thereon.

It is a yet further object of the present invention to provide such a device including an auxiliary strap and elongated wrap used in prescribed ways in conjunction with the inventive pant.

It is a yet further object of the present invention to provide such a pant which may be tightened at its upper and lower extremities.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
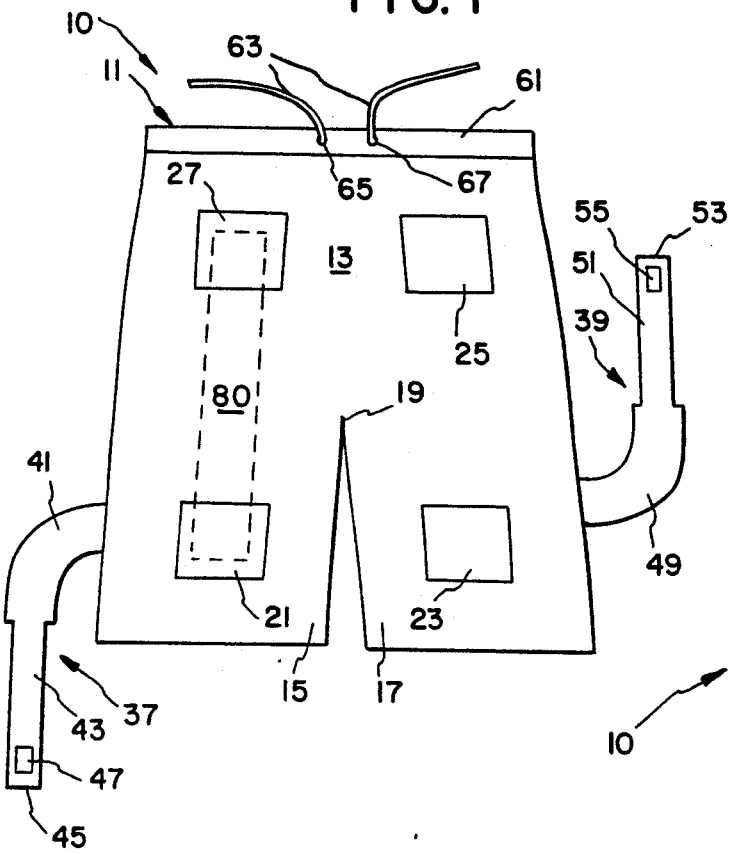
FIG. 1 shows a front view of the pants portion of the present invention.

With reference, first, to FIGS. 1-4, a main component of the present invention consists of a short pant generally designated by the reference numeral 10 and including a waist 11, an abdomen covering portion 13 and short legs 15 and 17 meeting at a crotch portion 19.

With reference to FIG. 1, it is seen that the front portion of the pant 10 has four squares 21, 23, 25 and 27 affixed thereto. In the preferred embodiment of the present invention, each of these squares consists of one-half of a hook and pile fastening means. In the preferred embodiment, each of these squares consists of the pile half of a hook and pile fastening means.

Figure 2:
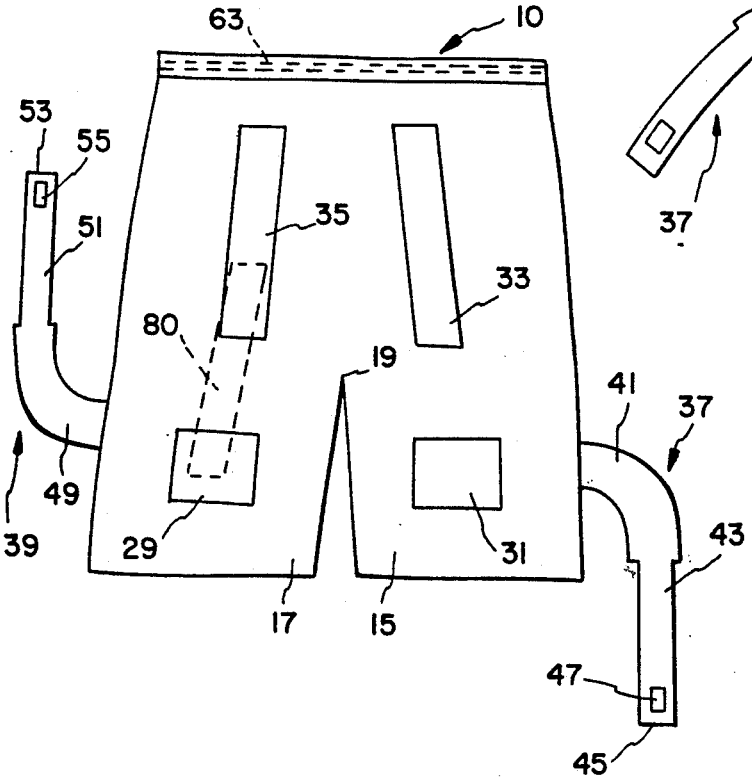
FIG. 2 shows a rear view of the structure shown in FIG. 1.

With reference to FIG. 2, it is seen that the rear of the pant includes additional hook and pile fastening means consisting of pile halves designated by the reference numerals 29, 31, 33 and 35.

Figure 3:
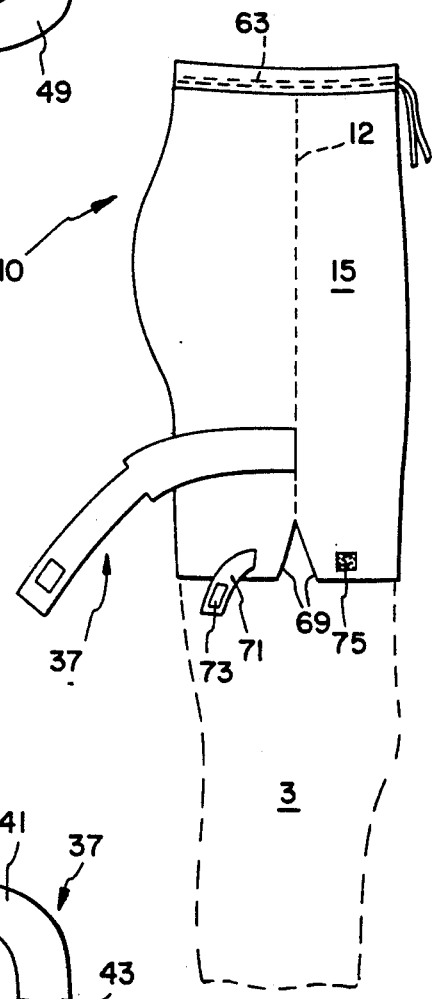
FIG. 3 shows a side view of the structure of FIGS. 1 and 2.

As best shown in FIGS. 1-3, on the sides of the legs of the pant 10, two elongated straps 37 and 39 are attached. As seen in FIG. 3, the pant 10 has a side seam 12 at which location the strap 37 is attached. A similar seam (not shown) on the other leg 17 provides the location for attachment of the strap 39.

With reference to FIGS. 1-3, it is seen that the strap 37 includes a wide area 41 adjacent the pant leg 15, a narrower area 43 and a distal end 45 having attached thereto the hook half 47 of a hook and pile fastening means. Similarly, the strap 39 has a wider region 49 adjacent the pant leg 17, a narrower region 51 attached thereto, a distal end 53 and another hook half 55 of a hook and pile fastening means. If desired, each distal end 45, 53 may have a half 47, 55 on each opposed face thereof.

With reference back to FIG. 1, the waist portion 11 of the pant 10 may include a doubled over portion 61 providing a chamber about the waist 11, which chamber 61 contains the drawstring 63 which gains access to the chamber 61 through the holes 65 and 67. The drawstring 63 is shown in phantom in FIGS. 2 and 3. Alternatively, the drawstring 63 may be provided as part of the waistband thereof.

With reference to FIG. 3, it is seen that the leg 15 has a lower region including a triangular split 69 with a strap 71 on one side of the split and having one-half 73 of a hook and pile fastening means thereon. The other half of the hook and pile fastening means is designated by the reference numeral 75 and is located on the other side of the split 69. Thus, the strap 71 may be fastened with hook and pile fastening halves 73, 75 to tighten the split 69 and cause the pant leg 15 to tightly engage the leg 3 of the user. Corresponding structure (not shown) is provided on the pant leg 17.

Figure 5:
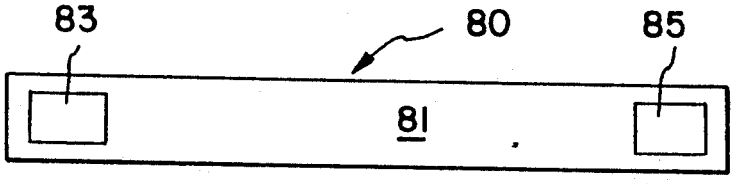
FIG. 5 shows a front view of an auxiliary strap forming a part of the present invention.

FIG. 5 shows an auxiliary strap 80 made in accordance with the teachings of the present invention, which auxiliary strap 80 is preferably two inches wide and comes in various lengths according to pant size. The auxiliary strap 80 includes a strap body 81 with two squares 83 and 85 of fastener material, with these square 83, 85 preferably each comprising the hook half of a hook and pile fastening means. The auxiliary strap 80 is also shown in phantom in FIGS. 1 and 2 in two preferred modes of interconnection. In the preferred mode of operation of the present invention, the auxiliary strap 80 is intended to be interconnected between, for example, the pile fastener halves 27, 21; 25, 23; 35, 29; or 33, 31. Through the use of the auxiliary strap 80, which preferably consists of an elastic material, support is provided for musculature and tissues in the vertical direction and the elastic nature of the auxiliary strap 80 provides a restoring force tending to assist the muscles in working from a tensed state to a state of relaxation.

Figure 6:
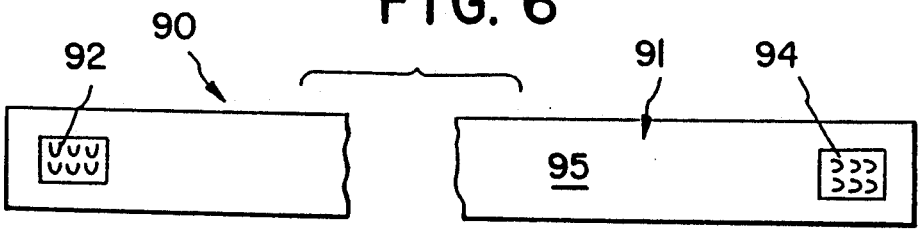
FIG. 6 shows a front view of an elongated wrap forming a part of the present invention.
Figure 7:
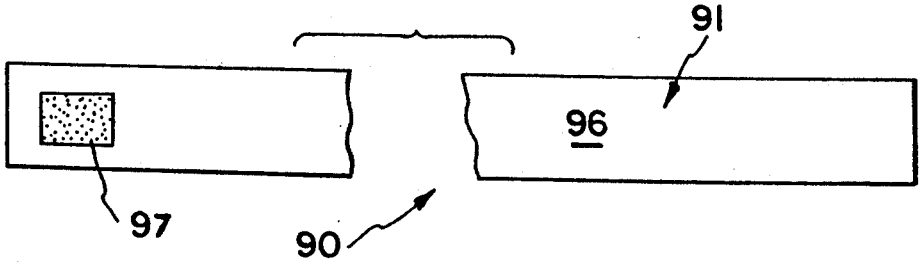
FIG. 7 shows a rear view of the wrap shown in FIG. 6.

FIGS. 6 and 7 depict an elongated wrap 90 having an elongated body 91, preferably made of an elastic material and, in the preferred embodiment of the present invention being four inches wide. Of course, this dimension is merely exemplary.

FIG. 6 shows the face 95 of the elongated wrap 90 and shows that this face 95 has, at its opposed ends, squares 92 and 94 which consist of hook halves of a hook and pile fastening means. FIG. 7 shows the face 96 of the elongated wrap 90 and shows, at one end thereof, a square 97 consisting of a pile half of a hook and pile fastening means. Of course, if desired, the respective locations of the various hook and pile halves may be reversed.

Now, with the structure of the present invention having been described in detail, a detailed explanation of the preferred manner of interaction of the pant 10 and auxiliary strap 80, elongated wrap 90 will now be described.

As stated above, the present invention has several primary major applications which are merely exemplary and not intended to be limiting. Through application of the teachings of the present invention, the following conditions may be treated in such a way that the patient will rehabilitate more quickly than would be the case without the use of the present invention, and, in fact, the patient may be able to perform athletically while wearing the present invention even despite having one of these conditions as follows: adductor strains or tears, gracilis or sartorius; strains of the quadriceps/-rectus femoris; strains of the support hamstring; tendonitis over ASIS; strains of the hip flexor; contusions of the deep thigh.

As stated above, part of the rehabilitation process for the injuries which may be treated in accordance with the teachings of the present invention is to provide support to the afflicted muscle group by providing compression when muscles are at their shortest lengths While these muscles are being moved, it is also desirable to keep them warm. The present invention, especially the pant 10, is specifically designed not only to be flexible to provide the appropriate support but also to be insulative in nature to keep the afflicted muscles warm. As stated above, one preferred material for use in making the pant 10 consists of neoprene rubber, for example in a thickness of two millimeters. Of course, other resilient insulative materials may appropriately be used in making the pant 10.

While the present invention is particularly useful in assisting the rehabilitation of injured muscles, it also finds particularly effective use in a healthy person since its ability to support muscle groups and keep them warm acts as a preventive measure supporting muscles and keeping them warm to prevent injuries from taking place in the first place.

In applying the teachings of the present invention, the pant 10 is pulled on over the legs of the user and up to the waist level. The drawstring 63 is suitably tightened to prevent the pant 10 from moving downwardly. Similarly, the straps 71 are fastened, pulling tight the splits 69 while the hook and pile fastening halves 73, 75 engage one another, to prevent the pant legs 15, 17 from riding upwardly.

Figure 4:
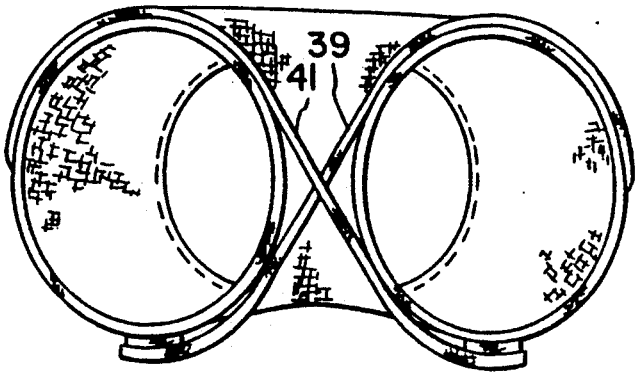
FIG. 4 shows a view looking upwardly from below of the structure of FIGS. 1-3.
Figure 8:
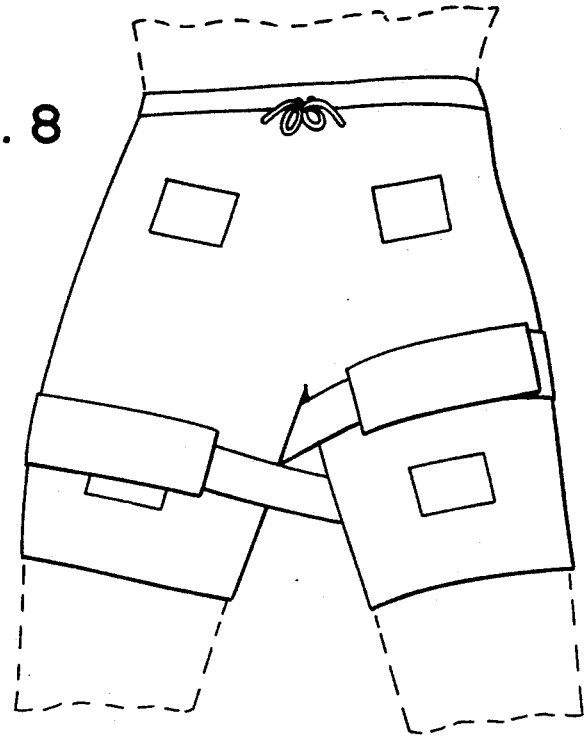
FIG. 8 shows a front view of the inventive system in one orientation of parts.

As is known, in rehabilitating a groin strain, it is important to prevent lateral movement of the thighs. Thus, affixing the straps 37, 39 as best illustrated in FIGS. 4 and 8 is intended to fulfill this purpose. As explained above, each strap has an end, 45, 53, respectively having two faces each of which has the hook half of a hook and pile fastening means thereon. This structure is referred to by the reference numeral 47 on the strap 37 and 55 on the strap 39. The configuration particularly shown in FIG. 8 is achieved by affixing the hook half 47 of the strap 37 on the pile half 29 at the rear of the pant 10 while, simultaneously, the hook half 55 of the strap 39 is affixed to the pile half 31 affixed to the back of the pant 10. These pile halves 29 and 31 are seen in FIG. 2.

With the straps 37, 39 in the orientation shown in FIGS. 4 and 8, lateral movements of the legs with respect to one another are resisted by the elasticity of the straps 37 and 39. This elasticity not only resists lateral movements but also assists the legs in restoring themselves to a position adjacent one another, the best position for the legs to be in while rehabilitating a groin strain or tear. As should be understood, the large area of the fastener halves 29, 31 allows the user to adjust the amount of tension which is employed using the straps 37 and 39. Thus, the attachment half on a particular strap, 37 or 39, may be placed on its corresponding pile half 29 or 31 either close to the crotch 19 or far away therefrom with the furthest attachment providing the greatest amount of tension and restoring force.

As shown in phantom in FIGS. 1 and 2 and as described above, the auxiliary strap 80 may be employed to assist the muscles in one direction of motion thereof. Thus, FIG. 1 shows the auxiliary strap 80 stretched between the fastener halves 21, 27 with the hook portions 83, 85 thereof respectively attaching to the pile halves 21, 27. In this way, the auxiliary strap 80 due to its elasticity assists a muscle in contracting after it has expanded. Similarly, FIG. 2 shows the auxiliary strap 80 attached between the fastener halves 29, 35 to, again, assist the musculature in contracting after having expanded.

With attention back to FIG. 1, it should be understood that the manner of placement of the auxiliary strap 80 between the fastener halves 21, 27 determines its degree of effectiveness with regard to various types of injuries. Thus, due to the large area subtended by the fastener halves 21, 27, the auxiliary strap 80 may be placed thereon in several different ways. Thus, for example, attaching the auxiliary strap 80 in a manner similar to that which is shown in FIG. 1 but closer to the crotch area 19 will cause the auxiliary strap 80 to be effective in assisting the adductor muscles which are damaged in a groin pull or tear. Leaving the auxiliary strap 80 in the position shown in FIG. 1 but pulling the upper portion thereof further upwardly to the uppermost extreme of the fastener half 27 renders the auxiliary strap 80 effective in treating hip flexor injuries. Furthermore, in the position shown in FIG. 1 of the auxiliary strap 80 as well as moving the auxiliary strap 80 to its outer most possible degree of attachment between the fastener halves 21 and 27 renders the auxiliary strap 80 useful in treating thigh muscle contusions by assisting the action of the quadriceps and reducing stress on the injured portion of the muscle.

Attachment of the auxiliary strap 80 as shown in FIG. 2 renders it useful in assisting the hamstring muscles in contracting after they have expanded.

Figure 9:
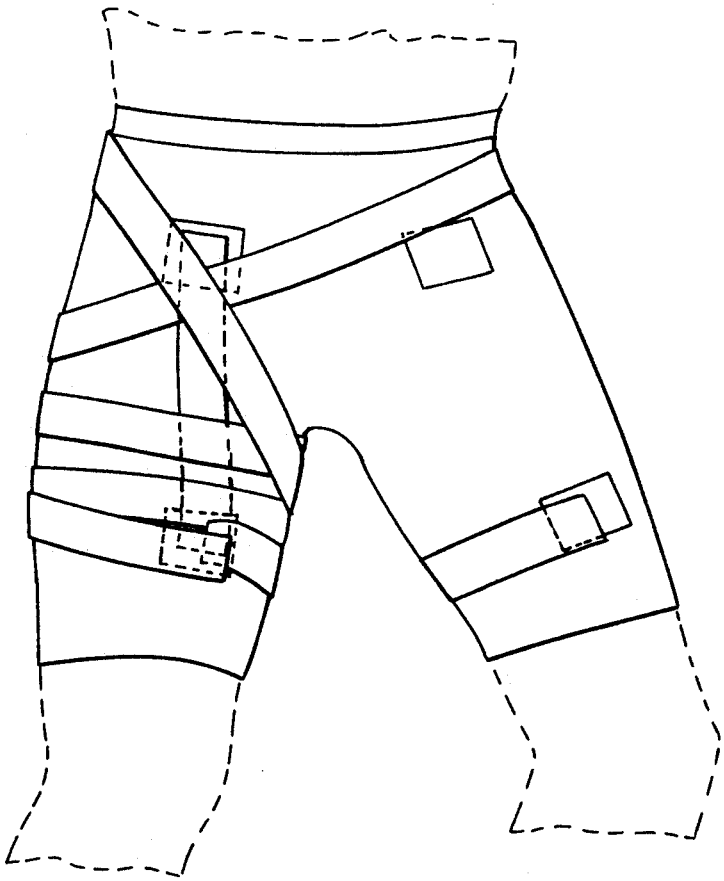
FIG. 9 shows a front view of the inventive system in a further orientation of parts.

In one preferred mode of practicing rehabilitation using the teachings of the present invention, the auxiliary strap 80 is placed in one of its potential locations as described above and, thereafter, the elongated wrap 90 may be placed as illustrated, for example, in FIG. 9. As shown, the auxiliary strap 80 is affixed between the fastener halves 21 and 27 in a desired configuration, particularly designed to assist the adductor muscle. Thereafter, the elongated wrap 90 is affixed by first fastening the hook end 92 thereof on the pile half 31 illustrated in FIG. 2 and thereafter winding several rotations about the right thigh of the user, wrapping at least once about the waist of the user and wrapping one additional wrap about the right thigh and fastening the hook end 94 at one of the various pile fastening halves on the pant 10. In this way, the pant 10 is utilized as a "base" on which the wrap is placed which assists in heat retention and support while allowing the elongated wrap 90 to further concentrate pressure at the appropriate places. In this way, leverage support is provided by allowing the good limb (hip) to act as a base and lever to support the injured limb.

The examples described above clearly demonstrate the attributes of the present invention. In accordance with teachings of the present invention, a damaged muscle is provided with compression, support and is maintained warm due to the inherent heat retentive qualities of the pant 10. The inventive system may be utilized not only to rehabilitate damaged muscles but in a perfectly healthy athlete to assist in precluding injuries from taking place in the first place.

As should be understood, due to the great versatility afforded by the plurality of pile half locations on the pant, the elongated wrap 90 may be wrapped in any one of a multiplicity of configurations all known to athletic trainers and all effective in facilitating the rehabilitation of damaged muscles as well as, in accordance with the teachings of the present invention, being usable to prevent injuries from taking place in the first place.

As such, an invention has been disclosed in terms of an apparatus and method for its practice which fulfills each and every one of the objects of the invention as set forth above and provides a new and useful rehabilitation device of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

We claim:

1. A rehabilitation device, consisting essentially of:

a) a stretchable pant having a waist portion and two depending circumferentially extending stretchable leg portions;

b) each leg portion having a front surface and a rear surface, either each said front surface or each said rear surface having a first attachment member mounted thereon;

c) said pant having two opposed sides defined by vertical lines of merger of respective front and rear surfaces, each side having an elongated elastic strap extending therefrom and having a distal end with a second attachment member mounted thereon; and d) said first and second attachment members being interengageable to fasten a said strap in a desired stretched configuration on said pant whereby a large region of a muscle may be mechanically supported by said stretchable pant and a small region of said muscle within said large region may be further mechanically supported by a said strap either while soft tissue damage is healing or to prevent recurrence of such damage.

2. The invention of claim 1, wherein each of said front surfaces and rear surfaces has a first attachment member thereon.

3. The invention of claim 1, wherein each of said sides has a lower split terminus and a tightening strap selectably fastenable in differing degrees of tightness across said terminus to tighten each leg portion about a leg contained therein.

4. The invention of claim 1, wherein said waist portion has a drawstring.

5. The invention of claim 1, wherein said pant has a circumferential region immediately below said waist portion, and a third attachment member on said region.

6. The invention of claim 5, wherein said third attachment member comprises a plurality of third attachment members.

7. The invention of claim 5, further including an auxiliary strap having opposed ends each carrying a fourth attachment member releasably attachable to either one of a said first or third attachment member.

8. The invention of claim 5, wherein said third attachment member is elongated.

9. The invention of claim 6, including four elongated third attachment members.

10. The invention of claim 1, wherein each of said elongated straps has a wider region adjacent said pant and a narrower region distal therefrom.

11. The invention of claim 1, wherein said pant is made of rubber.

12. The invention of claim 1, further including an elongated flexible wrap attachable to one of said first attachment members, said wrap being wound in a desired pattern on said pant and fastenable thereon.

13. The invention of claim 12, wherein said wrap has first and second faces and first and second ends, said first end having a third attachment member on said first face and a fourth attachment member on said second face, said second end having a third attachment member on said second face.

* * * * *